US011060722B2

(12) United States Patent
Petela

(10) Patent No.: US 11,060,722 B2
(45) Date of Patent: Jul. 13, 2021

(54) BURNER FOR A FLARE

(71) Applicant: NOVA Chemicals (International) S.A., Fribourg (CH)

(72) Inventor: Grazyna Petela, Calgary (CA)

(73) Assignee: NOVA Chemicals (International) S.A., Fribourg (CH)

( * ) Notice: Subject to any disclaimer, the term of this patent is extended or adjusted under 35 U.S.C. 154(b) by 69 days.

(21) Appl. No.: 16/325,212

(22) PCT Filed: Aug. 24, 2017

(86) PCT No.: PCT/IB2017/055105
§ 371 (c)(1),
(2) Date: Feb. 13, 2019

(87) PCT Pub. No.: WO2018/037369
PCT Pub. Date: Mar. 1, 2018

(65) Prior Publication Data

US 2019/0195491 A1 Jun. 27, 2019

(30) Foreign Application Priority Data

Aug. 24, 2016 (CA) ..... CA 2939751

(51) Int. Cl.
*F23G 7/08* (2006.01)
*F23D 14/58* (2006.01)
(Continued)

(52) U.S. Cl.
CPC ..... *F23G 7/08* (2013.01); *F23D 14/02* (2013.01); *F23D 14/24* (2013.01); *F23D 14/58* (2013.01);
(Continued)

(58) Field of Classification Search
CPC ..... F23G 7/08; F23G 7/02; F23D 14/02
See application file for complete search history.

(56) References Cited

U.S. PATENT DOCUMENTS 4,039,276 A 8/1977 Reed et al.
5,641,282 A * 6/1997 Lee ..... F23D 14/16 126/91 A
(Continued)

FOREIGN PATENT DOCUMENTS

CA 2288420 11/1999
DE 1024904 2/1958
(Continued)

OTHER PUBLICATIONS

Aste, Tomaso and Weaire, Denis; The Pursuit of Perfect Packing, Section 2 (Loose change and hard packing) and Section 3 (Hard Problem with Hard Spheres); London Institute of Physics, Copyright 2008, pp. 5-8 and 11-18.
(Continued)

*Primary Examiner* — Jason Lau
(74) *Attorney, Agent, or Firm* — Fish & Richardson P.C.

(57) ABSTRACT

A tip burner for a flare comprises a diffuser (7) which is sealingly connected downstream to a shroud (9) comprising a tightly packed bed of granular material (13). The stream of fuel and oxidizer flows to a diffuser where is mixed and tangentially swirled by a swirler (8) located either in the diffuser or in a closed proximity to the diffuser inlet. The mixture flows next to the shroud where the granular material provides a tortious flow path for the stream, restructuring it aerodynamically and reducing its velocity, preferably to sub sonic level. A combustible mixture exits the shroud as multiple of jet, at low velocity and low turbulence. The mixture is ignited by a pilot burner installed above but in close proximity of the shroud, resulting in a stable flame which generates a low noise level.

12 Claims, 3 Drawing Sheets

(51) Int. Cl.
*F23D 14/24* (2006.01)
*F23D 14/02* (2006.01)

(52) U.S. Cl.
CPC .... *F23D 2210/00* (2013.01); *F23D 2212/105* (2013.01); *F23D 2212/203* (2013.01)

(56) References Cited

U.S. PATENT DOCUMENTS

| | | | |
|---|---|---|---|
| 6,343,672 | B1 | 2/2002 | Petela et al. |
| 7,247,016 | B2 | 7/2007 | Mashhour |

FOREIGN PATENT DOCUMENTS

| | | |
|---|---|---|
| DE | 8807395 | 9/1988 |
| GB | 2136555 | 9/1984 |
| WO | WO2008055829 | 5/2008 |

OTHER PUBLICATIONS

Conway, J.H. and Cloane, J.A.; Sphere Packings, Lattices and Groups, Chapter 6. Laminated Lattices; Copyright 1999, pp. 157-180.

Sloane, N.J.A.; The Packing of Spheres—What is the densest way to arrange identical spheres in space?—1983 Scientific American, Inc., pp. 116-125.

PCT International Preliminary Report on Patentability in International Application No. PCT/IB2017/055105, dated Feb. 26, 2019, 6 pages.

PCT International Search Report and Written Opinion in International Application No. PCT/IB2017/055105, dated Jan. 12, 2017, 10 pages.

* cited by examiner

BURNER FOR A FLARE

TECHNICAL FIELD

The present invention relates to noise suppression of flares which burn waste streams vented from industrial installations, while maintaining the same venting flow rate of the discharged stream. With the changing demographics, particularly in North America, hearing impairment is becoming a more visible disability. As a result, there is a desire to reduce the level of noise in industrial installations such as gas transmission facilities and chemical processing and manufacturing plants. While wearing hearing protection may help in some cases it has the disadvantage of limiting the communications between individuals who wear them. There is a need for industrial flame noise suppressors, particularly for applications to sonic or supersonic flares.

BACKGROUND ART

U.S. Pat. No. 4,039,276 issued Aug. 2, 1977 to Reed et al., assigned to John Zink Company teaches a noise and smoke retardant flare. The flare or burner for the flare comprises a vertical stack having a shroud in the form of a cylinder surrounding, and spaced outwardly from, the top portion of the stack, and extending above the top of the stack. The space between the shroud and the stack is closed off by an annular plate which serves to support the shroud from the stack. At the top of the shroud is a steam manifold which carries a plurality of steam nozzles spaced angularly around the inner face of the manifold, so as to direct high velocity steam jets inwardly and upwardly toward the axis of the stack. The nozzles are placed on the inner face of the manifold so as to be substantially below and inside of the outer contour of the manifold and the shroud. The outer circumference of the shroud near its bottom end is perforated with a plurality of circumferentially spaced openings through which air can pass to the annular space between the shroud and the stack. The upwardly moving air mixes with the gas flowing up the stack, and burns in the wind-protected zone above the top of the stack, and below the top of the steam manifold. Above the top of the steam manifold the jets of steam driving into the rising column of burning gas carry in combustion air and thoroughly agitate and mix the combustion air, the steam, and the burning gas. The reference fails to teach a diffuser mixing chamber and the packed bed of the present invention.

U.S. Pat. No. 7,247,016 issued Jul. 24, 2007 to Mashhour, assigned to Saudi Arabian Oil Company teaches a design similar to U.S. Pat. No. 4,039,276.

There are commercially available porous burner plates typically made of ceramic or metal. The flow of fuel and oxidant passes through the plate and are mixed to provide a more uniform oxidant fuel mixture. The mixture is ignited by a pilot burner at the upper surface of the burner plate. The flame is stable and tends to have low emissions. However such burner plates or frits tend to clog and it is difficult to clean them.

The present invention seeks to provide a burner for a flare having good flame stability, low NOX and low noise.

SUMMARY OF INVENTION

The present invention provides a burner, typically for a flare stack, comprising in co-operating arrangement:

i) an open upwardly expanding truncated conical mixing diffuser having an inlet receiving a gaseous feed comprising at least one fuel and an oxidant in a ratio to provide for the substantially complete combustion of the fuel at the burner exit;

ii) above and co-operating with the outlet of said mixing diffuser an upper shroud, which can be in a shape of an open upwardly expanding truncated cone or a cylinder;

iii) two perforated plates, continuous or segmented, which constitute the inlet and the outlet of the said shroud;

iv) within the shroud, a bed of inert, solid or hollow rigid tightly packed granules, said bed having the height at least equivalent to one inlet radius of the said shroud, and having a total cross sectional area of interstitial voids among the granules of not less than 2, in some embodiments not less than 2.25, in other embodiments not less than 2.5, in further embodiments not less than 3, times the cross sectional area of the inlet of the said diffuser; and v) one or more pilot burners above and proximate to the surface of the upper perforated plate which constitutes the shroud exit.

In a further embodiment the burner further comprises one or more arrays of swirling vanes either:

i) inside said diffuser mixing chamber, the said array comprising a set of vanes forming a series of radially enclosed channels to swirl, mix and discharge said streams of fuel and oxidizer, in a radially outward and tangential manner wherein the sum of the cross section areas of said channels is not less than 95% of the total cross section area of the diffuser inlet; or ii) inside the passages or tubing which deliver fuel and oxidizer to the said diffuser, and in proximity to the diffuser inlet, said arrays comprising a set of vanes forming a series of radially enclosed channels to swirl and discharge said respective streams of fuel and oxidizer in a radially outward and tangential manner into the mixing diffuser, wherein the sum of the cross section areas of said channels is not less than 95% of the total cross section area of the diffuser inlet.

In a further embodiment the perforated plates which constitute the inlet and outlet of the said shroud are selected from the group consisting of a wire mesh, a perforated plate and a grid of parallel metal bars defining openings there through, having a maximum size opening not more than 70% of the characteristic smallest dimension of the inert granular packing.

In a further embodiment the inert granular packing comprises the particles of the same size and the same regular shape selected from the group consisting of solid spheres, rods, pellets, prills, saddles, and rings, and mixtures thereof made of the material selected from the group consisting of metal, ceramic and polymeric materials, having a melting temperature not less than 50° C. greater than the adiabatic combustion temperature of the mixture of said at least one fuel and said oxidant.

In a further embodiment the inert granular packing comprises a mixture of irregularly shaped or differently shaped particles, with size distribution within ±25% of the average mean dimension.

In a further embodiment the inert granular packing is cleaned and sieved gravel having a size distribution within ±25% of average sieve size.

In a further embodiment the shroud containing the granular material, has a diameter substantially the same size as the outlet of said diffuser and has a length to radius ratio of not less than 1:2.

In a further embodiment the shroud has an exit diameter from 2 to 15 times the diameter the said diffuser inlet and has a length to radius ratio of not less than 1.

In a further embodiment in the mixing diffuser the angle α of the side wall is from 10° to 50° off vertical.

In a further embodiment said diffuser is an upward opening truncated cone.

In a further embodiment the diffuser contains swirling vanes, which are uniformly radially spaced.

In a further embodiment the vanes have a tangential deflective angle greater than 5°.

In a further embodiment the vanes have straight parallel deflective edges.

In a further embodiment the vanes are wedged shaped.

In a further embodiment the vanes are curved.

In a further embodiment upstream and proximate to the inlet to the diffuser, separate arrays of swirling vanes are in the oxidant passage and in the fuel passage, so the gas and the oxidant are separately swirled, before they tangentially enter the diffuser inlet.

In a further embodiment the swirling vanes are mounted upstream and proximate to the inlet of the diffuser in the oxidant passage(s) so only oxidant is swirled, before it tangentially enters the diffuser.

In a further embodiment the swirling vanes are mounted upstream and proximate to the inlet of the diffuser in the fuel passage(s) so only fuel stream is swirled, before it tangentially enters the diffuser.

BEST MODE FOR CARRYING OUT THE INVENTION

Figure 1:
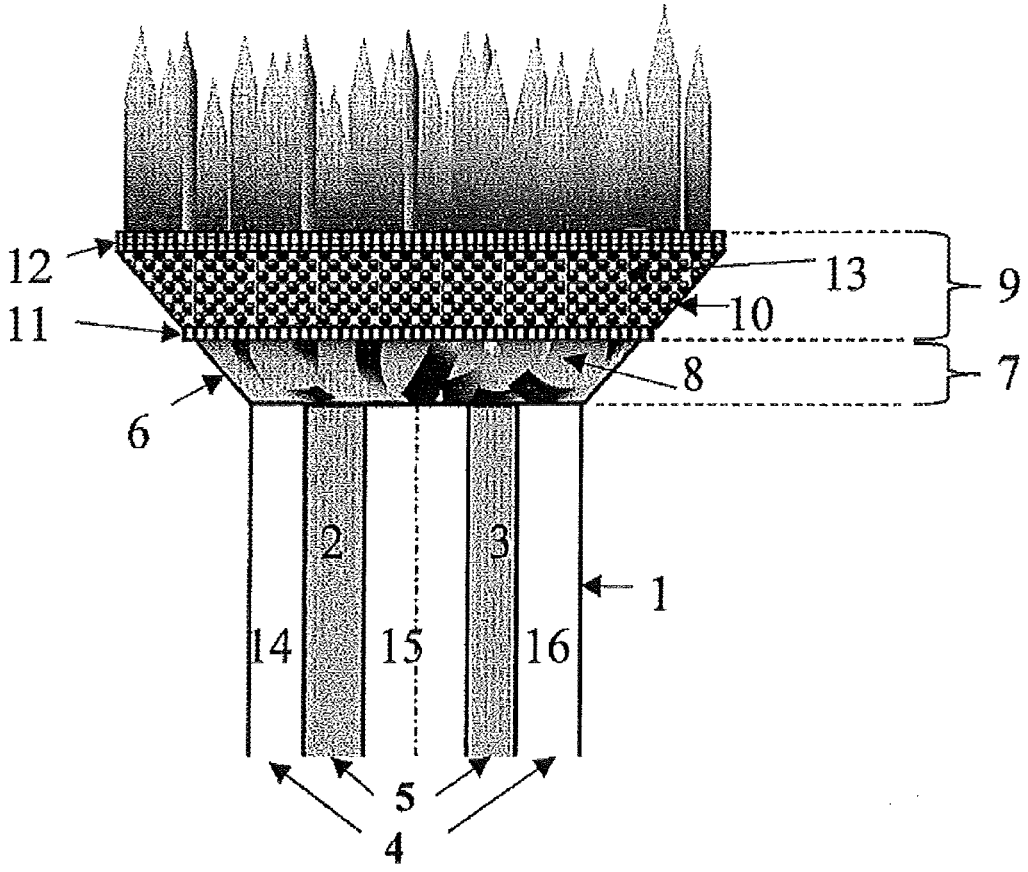
FIG. 1 is schematic diagram of one embodiment of a burner for a flare in accordance with the present invention.
Figure 2:
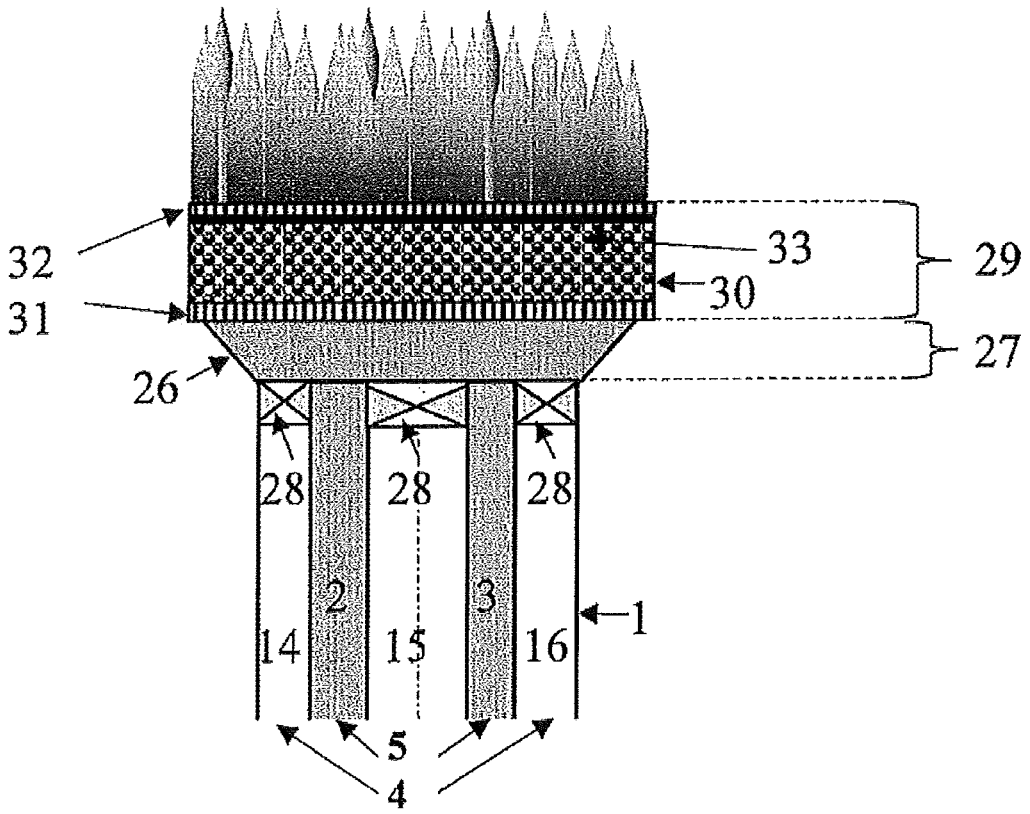
FIG. 2 is a schematic diagram of one embodiment of a burner for a flare in accordance with the present invention.

The present invention is directed to a silencing burner for a flare. The silencing burner has low noise level (generally less than 95 dBA, preferably less than 85 dBA) and has a stable flame. FIGS. 1 and 2 show two different versions of a silencing burner for a flare.

In FIG. 1 the burner is installed on top of a flare stack. In this figure and in FIG. 2 the flare stack 1 has internal passages/pipes or channels 14, 15 and 16 to feed a gaseous oxidant 4, typically air, and channels 2 and 3 to feed a gaseous fuel 5 to the burner. However, other arrangements are known such as e.g. separate feed pipes feeding fuel and oxidant to the bottom of the burner.

In FIG. 1 the flare stack 1 is sealingly connected to the (silencing) burner. The burner comprises a mixing diffuser 7 comprising one or more side walls 6. In the embodiment shown, side wall 6 is an open upwardly facing truncated cone. Inside the mixing diffuser are one or more arrays of swirling vanes 8 forming a series of radially enclosed channels to swirl, mix and discharge said streams of fuel and oxidizer, in a radially outward and tangential manner wherein the sum of the cross section areas of said channels is not less than 95% of the cross section area of the diffuser inlet. A shroud 9 comprising one or more side walls 10. In the figure side wall 10 is an open upwardly facing truncated cone. Side wall 10 of shroud 9 cooperates and sealingly engages side wall 6 of the mixing diffuser 7. At the entrance and exit of the shroud are lower and upper perforated plates or discs 11 and 12 respectively. The plates or discs may have a unity body construction or be composed of segments. In the shroud 9, contained between the perforated plates 11 and 12 and side wall 10, is a tightly packed bed of granular material 13. Not shown in the figure are one or more pilot burners adjacent to the perimeter of the upper perforated disk 12. The one or more shroud side walls 10 may extend above the upper perforated plate in which case the side wall 10 would have an opening in it to permit the flame from the pilot get in the contact with the combustible mixture exiting from the upper perforated plate 12.

In FIG. 1 the shroud side wall 10 has an inward angle from 10° to 50° off vertical from the upper perforated plate 12 to the lower perforated plate 11. The mixing diffuser and shroud side walls, 6 and 10 respectively need not be unitary. There could be a side wall 10 around bed of tightly packed granular material 13 and a separate side wall 6 around the mixing diffuser 7 but in that case both side walls have to cooperate to form a sealing engagement.

In FIG. 2 the burner is installed on top of a flare stack. In this figure (and in FIG. 1) the flare stack 1 has internal passages/pipes or channels 14, 15 and 16 to feed a gaseous oxidant 4, typically air, and channels 2 and 3 to feed a gaseous fuel 5 to the burner. However, other arrangements are known, such as e.g. for separate feed pipes delivering fuel and oxidizer to the bottom of the burner.

In FIG. 2 the flare stack 1 is sealingly connected to the (silencing) burner. The burner comprises a mixing diffuser 27 comprising one or more side walls 26. In the embodiment shown the diffuser comprises a single side wall 26 in shape of an open upwardly facing truncated cone. In this embodiment there are no arrays of swirling vanes inside the mixing diffuser 27. Rather one or more arrays of swirling vanes 28 are located in the stack 1 proximate to the inlet 28 of the mixing diffuser forming a series of radially enclosed channels to swirl, mix and discharge said streams of fuel and oxidizer, in a radially outward and tangential manner wherein the sum of the cross section areas of said channels is not less than 95% of the total cross section area of the diffuser inlet. In the arrangement presented in FIG. 2, the swirling vanes 28 are located only in the oxidant/air passage, while fuel stream remain unswirled. A shroud 29 comprises one or more side walls 30. In the figure, side wall 30 is an open upwardly facing cylinder. Side wall 30 of shroud 29 cooperates and sealingly engages side wall 26 of the mixing diffuser 27. At the entrance and exit from the shroud 29 are installed lower and upper perforated plates or discs 31 and 32 respectively. The plates or discs may have a unity body construction or be composed of segments. In the shroud 29, contained between side wall 30 and the perforated plates 31 and 32, is a tightly packed bed of granular material 33. Not shown in the figure are one or more pilot burners adjacent to the perimeter of the upper perforated disk 32. The one or more shroud side walls 30 may extend above the upper perforated plate in which case the side wall 30 would have an opening in it to permit the flame from the pilot get in the contact with the combustible mixture exiting from the upper perforated plate 32.

In FIG. 2 the shroud side wall 30 is vertical and cylindrical. The side wall 30 of the shroud 29 and side wall 26 around the mixing diffuser 27 have to cooperate to form a sealing engagement.

Figure 3:
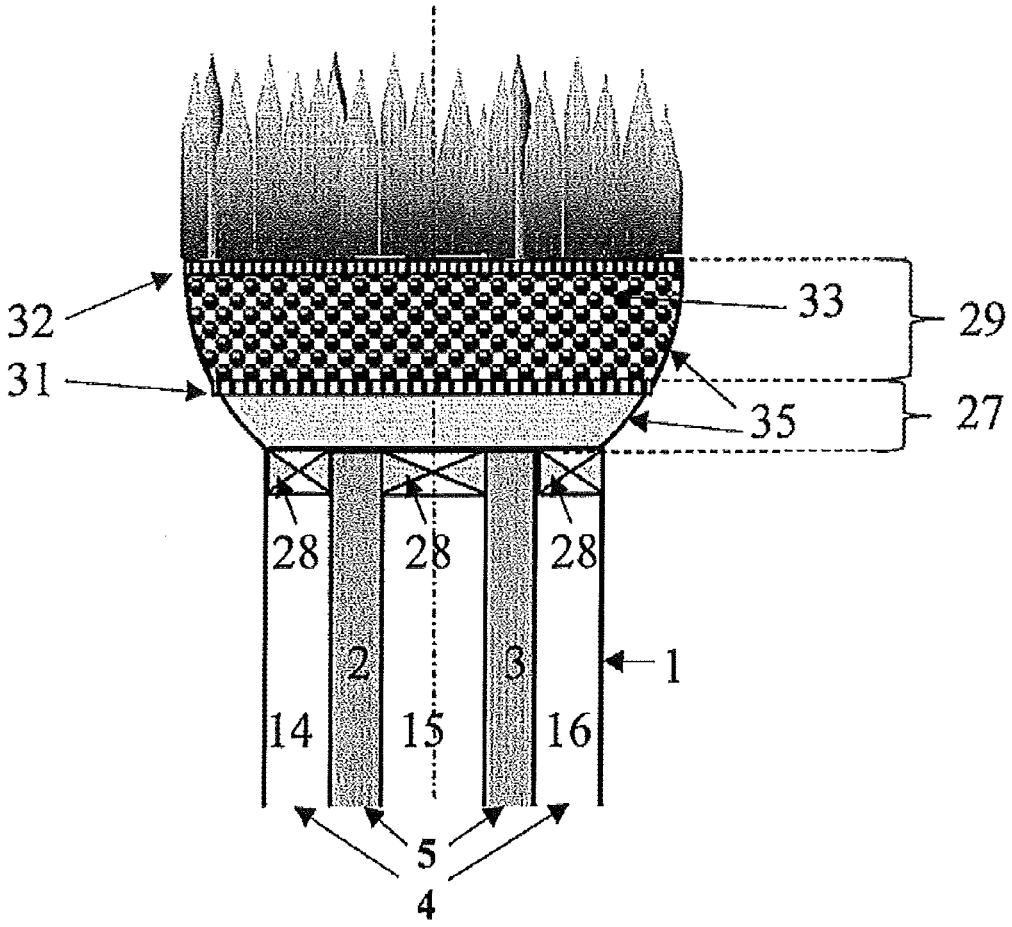
FIG. 3 is a schematic diagram of one embodiment of a burner for a flare in accordance with the present invention wherein the diffuser and shroud are a unitary parabolic form.

In the preceding embodiments the side wall of the mixing diffuser is open (hollow) upwardly opening truncated cone and the side wall of the shroud is open (hollow) upwardly opening truncated cone or cylinder. Other shapes could be used for example hollow upwardly opening parabolas or hemisphere, as is shown in FIG. 3, in which case the side wall would comprise a single or unitary side wall. In FIG. 3 the components have the same reference numbers as in FIG. 2 except there is a unitary parabolic wall 35 for both the diffuser and the shroud. The side wall could be in the form or a truncated cone or parabola in sections such as a half section provided the sections fit together to provide a substantially "air tight" wall. The walls of the shroud or the mixing diffuser, or both need not necessarily be continuously smooth. For example the wall could be an n-sided polygon, however squares and triangles are not desired, preferably n is an integer greater than or equal to six.

The granular material in the bed is selected so that the total cross sectional area of the interstitial voids between the particles at the bed or shroud inlet is of not less than 2, in some embodiments not less than 2.25, in other embodiments not less than 2.5, in further embodiments not less than 3, times the cross sectional areas of the inlet to the diffuser.

For regularly shaped particles, such as spheres, the cross sectional area of the interstitial voids may be calculated using the methods known to estimate close-packing of particles in a granular bed, [see, for example, Aste T., Weaire D., (2000), The Pursuit of Perfect Packing, London, Institute of Physics Publishing, ISBN 0-7503-0648-3, Section 2 (Loose change and hard packing) & Section 3 (Hard Problem with Hard Spheres); Conway J. H., Sloane N. J., Bannai E. Sphere Packings, Lattices and Groups, Springer 1999, Sec. 6.3; and Sloane N. J. H., (1984), The Packing of Spheres, Scientific American 250, pgs. 116-125]. Assuming that the spheres are tightly packed, the interstitial area will depend on diameter of the spheres.

In some instances, for example, where the packing is irregularly shaped (e.g. gravel), it may be simpler to experimentally determine the cross sectional area of the interstitial voids between granules by filling a representative bed with a liquid, such as, water, measuring the volume and determining the change in volume with the change in the level of liquid in the bed to approximate the volume between particles, and then to determine the cross sectional area at different heights of the packing.

In one embodiment of the present invention, the bed of granular material is tightly packed. That is, the granular material is not simply poured into the bed. Rather, the granular material is placed in the bed/shroud and the shroud is subject to vibration (shaking) to pack the bed to achieve a tight and uniform packing.

One factor to ensure the efficient operation of some embodiments of the present invention is the adequate pressure drop as the gas flows through tortuous passages between granular material contained in the bed. The pressure drop should be sufficient to reduce the gas velocity to sub-sonic level, while the gas exits the perforated cap on the shroud at a pressure equal to the ambient pressure level.

The granular packing in the shroud creates the tortuous path for the flow of the stream of oxidant and fuel, which results in an aerodynamic restructuring of the stream which has pressure and velocity further reduced. The achieved reduction depends on the thickness of the granular layer and on the angle $\alpha$ of the wall of the conical shroud or on the diameter of the cylindrical shroud which is, in turn, determined by the exit diameter of the upstream diffuser. The diameter or size of the opening at the exit of the shroud is such that there is no substantial constraint on the mass flow rate of the fluid out of the shroud, but the velocity of fluid is substantially reduced, in case of sonic jets—preferably to subsonic velocity. The depth of packing to obtain a desired pressure drop to substantially atmospheric pressure may be calculated based on principles for fluid (gas) flow through a tightly packed granular bed. Once the bed depth is determined and the size of the exit from the diffuser is calculated, the angle of the wall of the diffuser may be determined as a function of the exit opening and the bed depth.

As noted above there are pilot burners proximate and external to the perforated upper plate of the shroud. Also in some cases the wall may extent up above the particulate bed to provide protection for the flame from destabilizing wind effects.

The operation of the burner will now be described.

A gaseous stream comprising fuel and oxidant, in some instances under high pressure, enters the inlet of the burner, and flows into the diffuser containing the swirling vanes. The fluid is there divided among the swirler channels into the smaller streams, which are discharged radially outwardly from the channel exits into the dissipative shroud, at tangential directions consistent with the shape of the swirling vanes.

Alternatively, fuel and oxidant flowing through their respective passages in the stack, are entering the swirling vanes which are located in the passage exits, in close proximity to the diffuser inlet. Thus, both streams are already swirled when they enter tangentially the diffuser.

The swirling streams, after impinging and mixing inside the diffuser, enter the shroud through the bottom perforated plate and flow upwards, through the circular cross section of the shroud. The gas flows through the constant or increasingly large cross section of the granular bed, which creates the tortuous path for the flow. As a result, the stream is aerodynamically restructured into multitude of smaller streams, which are of low turbulence, low velocity, and they experience further mixing and pressure losses combined with the simultaneous velocity reduction. The flow exits the diffuser through the top perforated plate, at atmospheric pressure and with a subsonic velocity. Accordingly, noise generated by the jet is significantly reduced.

The exiting jet is ignited by one or more pilot burners and because of the good mixing of fuel and oxidant as they pass through the burner, and because of low and uniform velocity of the jet, the flame is very stable.

INDUSTRIAL APPLICABILITY

A burner for a flare comprises swirler up stream of a packed bed to initially mix oxidant and fuel which then passes through the packed bed to reduce the velocity of the gases to sub sonic levels to reduce the noise of the flare.

The invention claimed is:

1. A burner comprising in co-operating arrangement:

i) an open upwardly expanding truncated conical mixing diffuser having an inlet receiving a gaseous feed comprising at least one fuel and an oxidant in a ratio to provide for the substantially complete combustion of the fuel at the burner exit;

ii) above and co-operating with the outlet of said mixing diffuser an upper shroud, which can be in a shape of an open upwardly expanding truncated cone or a cylinder;

iii) two perforated plates which constitute the inlet and the outlet of the said shroud;

iv) within the shroud, a bed of inert, solid or hollow rigid tightly packed granules, said bed having the height at least equivalent to one inlet radius of the said shroud, and having a total cross sectional area of interstitial voids among the granules at the shroud inlet of not less than 2 times the cross sectional area of the inlet of the said diffuser, wherein said perforated plates which constitute the inlet and outlet of the said shroud are selected from the group consisting of a wire mesh, a perforated plate and a grid of parallel metal bars defining openings there through, having a maximum size opening not more than 70% of the characteristic smallest dimension of the inert granular packing, wherein the inert granular packing comprises the particles of the same size and the same regular shape selected from the group consisting of solid spheres, rods, pellets, prills, saddles, and rings, and mixtures thereof made of the material selected from the group consisting of metal, ceramic and polymeric materials, having a melting temperature not less than 50° C. greater than the combustion temperature of the mixture of said at least one fuel and said oxidant, wherein the inert granular packing comprises a mixture of irregularly shaped or differently shaped particles, with size distribution within ±25% of the average mean dimension, and wherein the inert granular packing is cleaned and sieved gravel having a size distribution within ±25% of average sieve size;

v) one or more pilot burners above and proximate to the surface of the upper perforated plate which constitutes the shroud exit; and vi) one or more arrays of swirling vanes either:

i) inside the said diffuser, the said array comprising a set of vanes forming a series of radially enclosed channels to swirl, mix and discharge said streams of fuel and oxidizer, in a radially outward and tangential manner wherein the sum of the cross section areas of said channels is not less than 95% of the total cross section area of the diffuser inlet; or ii) inside passages or tubing which deliver fuel and oxidizer to the said diffuser, and in proximity to the diffuser inlet, said arrays comprising a set of vanes forming a series of radially enclosed channels to swirl and discharge said respective streams of fuel and oxidizer in a radially outward and tangential manner into the mixing diffuser, wherein the sum of the cross section areas of said channels is not less than 95% of the total cross section area of the diffuser inlet.

2. The burner according to claim 1, wherein the shroud containing the granular material, has a diameter substantially the same size as the outlet of said diffuser and has a length to radius ratio of not less than 1:2.

3. A burner comprising in co-operating arrangement:

i) an open upwardly expanding truncated conical mixing diffuser having an inlet receiving a gaseous feed comprising at least one fuel and an oxidant in a ratio to provide for the substantially complete combustion of the fuel at the burner exit;

ii) above and co-operating with the outlet of said mixing diffuser an upper shroud, which can be in a shape of an open upwardly expanding truncated cone or a cylinder;

iii) two perforated plates which constitute the inlet and the outlet of the said shroud;

iv) within the shroud, a bed of inert, solid or hollow rigid tightly packed granules, said bed having the height at least equivalent to one inlet radius of the said shroud, and having a total cross sectional area of interstitial voids among the granules at the shroud inlet of not less than 2 times the cross sectional area of the inlet of the said diffuser, wherein said perforated plates which constitute the inlet and outlet of the said shroud are selected from the group consisting of a wire mesh, a perforated plate and a grid of parallel metal bars defining openings there through, having a maximum size opening not more than 70% of the characteristic smallest dimension of the inert granular packing, wherein the inert granular packing comprises the particles of the same size and the same regular shape selected from the group consisting of solid spheres, rods, pellets, prills, saddles, and rings, and mixtures thereof made of the material selected from the group consisting of metal, ceramic and polymeric materials, having a melting temperature not less than 50° C. greater than the combustion temperature of the mixture of said at least one fuel and said oxidant, wherein the inert granular packing comprises a mixture of irregularly shaped or differently shaped particles, and wherein the shroud has an exit diameter from 2 to 15 times the diameter the said diffuser outlet and has a length to radius ratio of not less than 1:1;

v) one or more pilot burners above and proximate to the surface of the upper perforated plate which constitutes the shroud exit; and vi) one or more arrays of swirling vanes either:

i) inside the said diffuser, the said array comprising a set of vanes forming a series of radially enclosed channels to swirl, mix and discharge said streams of fuel and oxidizer, in a radially outward and tangential manner wherein the sum of the cross section areas of said channels is not less than 95% of the total cross section area of the diffuser inlet; or ii) inside passages or tubing which deliver fuel and oxidizer to the said diffuser, and in proximity to the diffuser inlet, said arrays comprising a set of vanes forming a series of radially enclosed channels to swirl and discharge said respective streams of fuel and oxidizer in a radially outward and tangential manner into the mixing diffuser, wherein the sum of the cross section areas of said channels is not less than 95% of the total cross section area of the diffuser inlet.

4. The burner according to claim 1, wherein in the mixing diffuser the angle a of the side wall is from 10° to 50° off vertical.

5. The burner according to claim 4, wherein said diffuser is an upward opening truncated cone.

6. The burner according to claim 5, wherein in said diffuser contains swirling vanes, which are uniformly radially spaced.

7. The burner according to claim 6, wherein said vanes have a tangential deflective angle greater than 5°.

8. The burner according to claim 7, wherein said vanes have straight parallel deflective edges.

9. The burner according to claim 8, wherein said vanes are wedged shaped.

10. The burner according to claim 7, wherein said vanes are curved.

11. The burner according to claim 5, wherein the swirling vanes are mounted upstream and proximate to the inlet of the diffuser in said passage(s) which delivers oxidizer to said diffuser so only oxidant is swirled, before it tangentially enters the diffuser.

12. The burner according to claim 5, wherein the swirling vanes are mounted upstream and proximate to the inlet of the diffuser in said passage(s) which delivers fuel to said diffuser so only fuel stream is swirled, before it tangentially enters the diffuser.

* * * * *